US005727878A

United States Patent [19]

Sullivan, Jr.

[11] Patent Number: 5,727,878

[45] Date of Patent: Mar. 17, 1998

[54] LINER FOR A MIXING CONTAINER AND AN ASSEMBLY AND METHOD FOR MIXING FLUID COMPONENTS

[75] Inventor: Joseph J. Sullivan, Jr., Scituate, Mass.

[73] Assignee: CDF Corporation, Plymouth, Mass.

[21] Appl. No.: 733,276

[22] Filed: Oct. 17, 1996

[51] Int. Cl.[6] ..... B01F 7/20; B01F 15/00

[52] U.S. Cl. ..... 366/247; 366/349; 366/605; 220/466; 220/470

[58] Field of Search ..... 366/45–57, 64–66, 366/241–252, 262–265, 270, 308, 347, 348, 349, 605; 220/466, 470

[56] References Cited

U.S. PATENT DOCUMENTS

| | | | |
|---|---|---|---|
| 3,027,044 | 3/1962 | Winstead | 220/470 |
| 3,126,197 | 3/1964 | Maurer et al. | 366/66 |
| 3,155,305 | 11/1964 | Bergstrom | 220/466 X |
| 4,171,751 | 10/1979 | Schutz | 220/466 X |
| 4,521,116 | 6/1985 | Adsit | 366/45 X |
| 4,635,814 | 1/1987 | Jones | 220/466 X |
| 5,302,017 | 4/1994 | Platek et al. | 366/47 X |
| 5,337,914 | 8/1994 | Mulder | 220/470 X |
| 5,441,341 | 8/1995 | Halsted | 366/47 |

*Primary Examiner*—Charles E. Cooley
*Attorney, Agent, or Firm*—Pandiscio & Pandiscio

[57] ABSTRACT

A flexible liner for use with a mixing container of the type having a bottom wall and a post extending inwardly of that bottom wall. The liner comprises a sleeve closed at its bottom end and open at its top end, and has a configuration generally complementary to the interior configuration of the container. The bottom end wall of the liner carries a fitment that has a tubular portion which has a closed top end and an open bottom end, and which has a configuration generally complementary to the configuration of the post. The bottom end of the sleeve has a hole in alignment with the tubular portion of the fitment. The liner is insertable into the container and conforms generally to the interior of the container, and the fitment fits over and receives the post. The tubular portion of the fitment receives a shaft that carries mixing blades for mixing fluids in the container. The flexible liner constitutes a barrier between the container and a fluid substance mixed therein.

6 Claims, 4 Drawing Sheets

LINER FOR A MIXING CONTAINER AND AN ASSEMBLY AND METHOD FOR MIXING FLUID COMPONENTS

BACKGROUND OF THE INVENTION

1. Field of the Invention

This invention relates to the mixing of fluid components and is directed more particularly to a liner for use with mixing containers, and an assembly and method for mixing fluid components in a liner-equipped mixing container.

2. Description of the Prior Art

The mixing of paint in facilities wherein paint is used on a large scale, as, for example, in automotive production plants, often is conducted in metal drums, e.g., common 55 gallon drums, equipped with a short upstanding post fixed to the center of the interior bottom surface.

Referring to FIG. 1, it will be seen that a typical prior art mixing assembly includes a 55 gallon container 10 having a closed end wall 12 and an open end 14. A post 16 is affixed to and upstands about 2¼ inches, or so, from the interior surface 18 of closed end wall 12. The post 16 is tiltable, usually to about 30°, from the container's longitudinal axis and also may, but need not be, rotatable about its own longitudinal axis.

The assembly further includes a mixing shaft 20 to which there are fixed mixing elements, such as blades 22. Mixing shaft 20 is hollow and has a cavity at its bottom end 24 so as to permit it to be rotatably mountable on post 16. The post 16, being tiltable, can adapt to small deviations of the shaft 20 from the center axis of container 10. The shaft 20 extends through a central opening 26 in a cover member 28.

In operation, a fluid 30, typically comprising two or more paint components, is introduced into the container 10 to a suitable level. The mixing shaft 20, with cover member 28 thereon, is then placed in the container 10. The bottom end 24 of the shaft 20 is positioned so that post 16 is received by its bottom end. Cover member 28 is then secured to the top of the container 10 to close the otherwise open end 14 thereof. This results in the shaft 20 being generally aligned with the longitudinal axis of container 10. The blades 22 are rigid so that they extend close to and are spaced from the interior surface of side wall 15 of container 10.

Then the top end 32 of the mixing shaft 20 is engaged by an electrically-powered turning device (not shown) which turns the shaft 20, thereby moving the blades 22 through the fluid 30. Of course, the rubber end of the shaft could be coupled to a manually-operated turning mechanism (also not shown).

Upon completion of the mixing operation, cover member 28 and mixing shaft 20 with blades 22 are removed from the container 10. The mixed paint is then transferred to other containers (not shown) or used directly from the container 10. In either case, the container 10 is not suitable for further like use and hence must be discarded. Disposal of the 55 gallon metal containers is objectionable because (1) the modified 55 gallon drums are expensive (typically costing more than $20 per drum) and (2) the drums are relatively large and disposing of thousands of drums involves a large disposal volume.

Accordingly, there is a need for a mixing assembly and method in which the mixing container need not be disposed of after a single use.

SUMMARY OF THE INVENTION

An object of the invention is, therefore, to provide a plastic liner which may be inserted into a mixing container prior to a fluid mixing operation and which constitutes a barrier between the mixing container and the fluid components therein.

A further object of the invention is to provide a container assembly for mixing paint and/or other fluid components, wherein a liner constitutes a barrier between the container and the fluid therein.

A still further object of the invention is to provide a method for mixing paint or other fluid components in a container wherein a plastic liner is used to prevent contact between the fluid component(s) and the container.

With the above and other objects in view, as will hereinafter appear, a feature of the present invention is the provision of a relatively flexible liner for use with a mixing container of the type having a post extending inwardly of the bottom wall of the container that is adapted to receive a shaft having mixing members mounted thereon, the liner comprising a sleeve closed at a first end thereof and open at a second end thereof that has a configuration generally complementary to the interior configuration of the container. The liner further comprises a stiff or rigid fitment fixed to the first end of the sleeve. The fitment is open at a first end thereof and closed at a second end thereof and has a configuration generally complementary to the configuration of the post. The first end of the sleeve has a hole in alignment with the fitment open end. The liner is insertable into the container and is shaped and sized so as to conform generally to the interior of the container. When the liner is so inserted in the container, the fitment fits over and receives the post, with the fitment then serving as a cylindrical bearing that is received by and supports the shaft. Thus, the liner constitutes a barrier between the container and a substance mixed therein.

In accordance with a further feature of the invention, there is provided an assembly for mixing fluid components, the assembly comprising a mixing container having a first end that is closed off by an end wall and a second open end, a post fixed to said end wall, the post extending inwardly of the container, and a mixing shaft adapted to be coupled to the post and having mixing members fixed thereon. The assembly further includes a liner in the form of a sleeve having a first end closed off by an end wall and a second opposite end that is open, the liner having a configuration that is generally complementary to the interior configuration of the container, and a sleeve-like fitment fixed to the end wall of the sleeve, the fitment being hollow so as to fit over the post. The liner is inserted into the container and generally conforms to the interior configuration of the container, with the fitment fitting over the post and receiving the shaft. Thus, the sleeve constitutes a fluid barrier between the container and the fluid components.

In accordance with a still further feature of the invention, there is provided a method for mixing fluid components, the method comprising the steps of providing a mixing container having a closed bottom end and an open top end, and having a post fixed to and upstanding from the interior of the closed bottom end, providing a cover member for the container having a hole centrally thereof, providing a mixing assembly including a shaft and mixing members fixed to the shaft, providing a liner comprising a sleeve closed at a bottom end thereof and open at a top end thereof and of a configuration generally complementary to the interior configuration of the container, the sleeve including a fitment that is fixed to the interior bottom end of the sleeve, and is open at a bottom end thereof and closed at a top end thereof, the fitment being of a configuration generally complementary to the configuration of the post, the bottom end of the sleeve defining a hole in alignment with the fitment open bottom end, inserting the liner into the container so that the fitment fits over the post, admitting fluid components to the open volume defined by the liner, placing the shaft of the mixing assembly onto the fitment, closing the open top end of the container with the cover member, with the shaft extending through the hole in the cover member, and rotating the shaft so as to cause the mixing members to mix the fluid components.

The above and other features of the invention, including various novel details of construction and combinations of parts, will now be more particularly described with reference to the accompanying drawings and pointed out in the claims. It will be understood that the particular devices and method embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent.

In the drawings.

DESCRIPTION OF THE PREFERRED EMBODIMENTS

Figure 1:
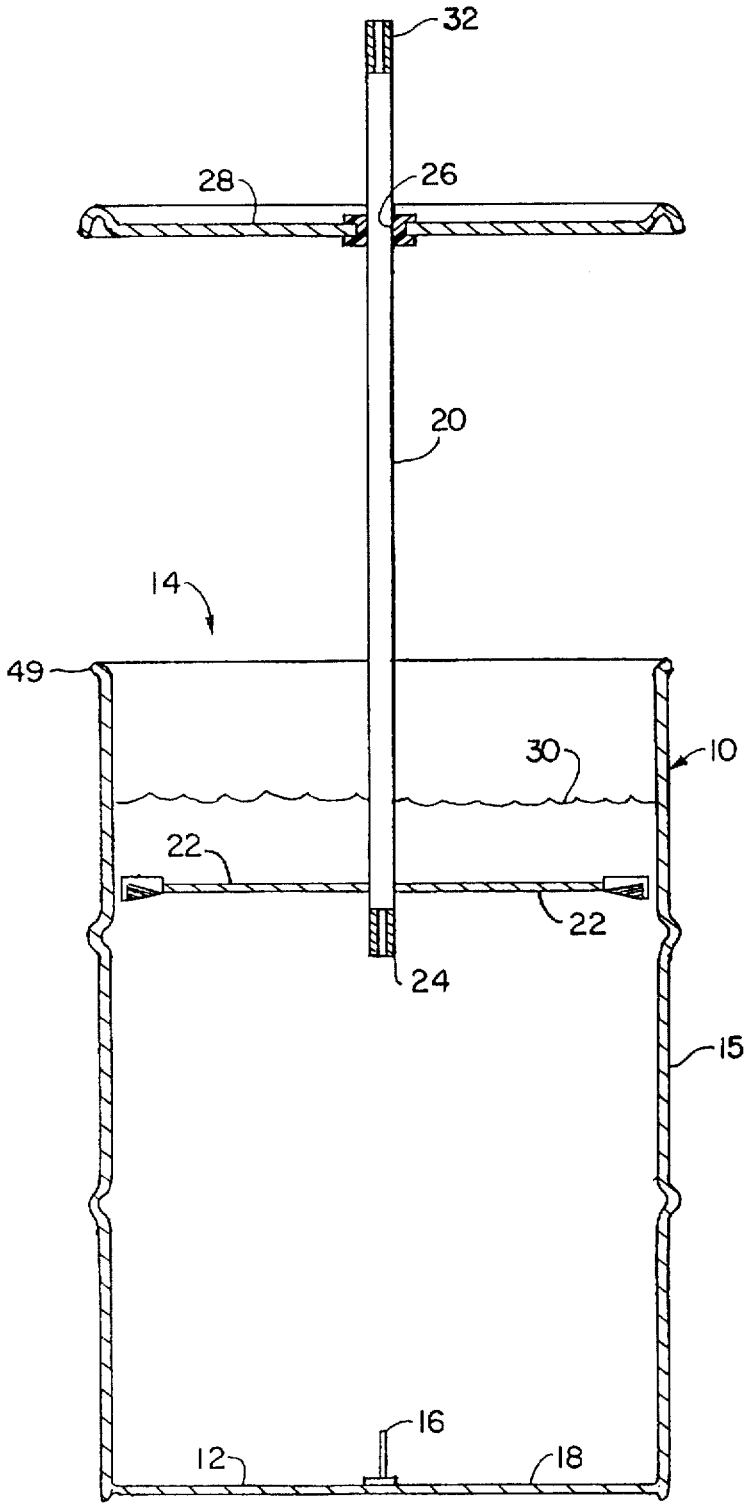
FIG. 1 PRIOR ART
FIG. 1 is an exploded sectional view of a prior art mixing assembly.
Figure 2:
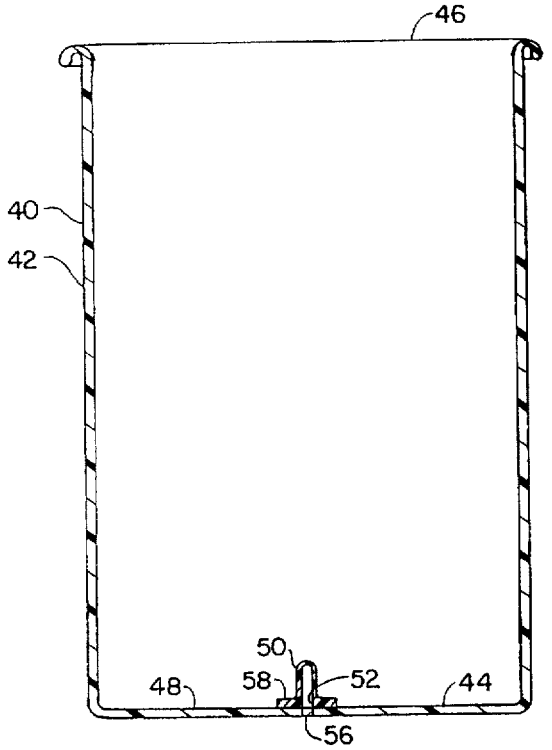
FIG. 2 is a sectional view of one form of liner illustrative of an embodiment of the invention.

Referring to FIG. 2, it will be seen that a liner 40 for use with the mixing container 10 comprises a sleeve 42 closed off by a bottom end wall 44 thereof and having an open top end 46. Sleeve 42 is of a configuration generally complementary to the interior configuration of container 10. The container may be a 55 gallon drum modified as described hereinafter. Sleeve 42 is made of a flexible fluid-impervious material, preferably polyethylene or an elastomer.

Figure 3:
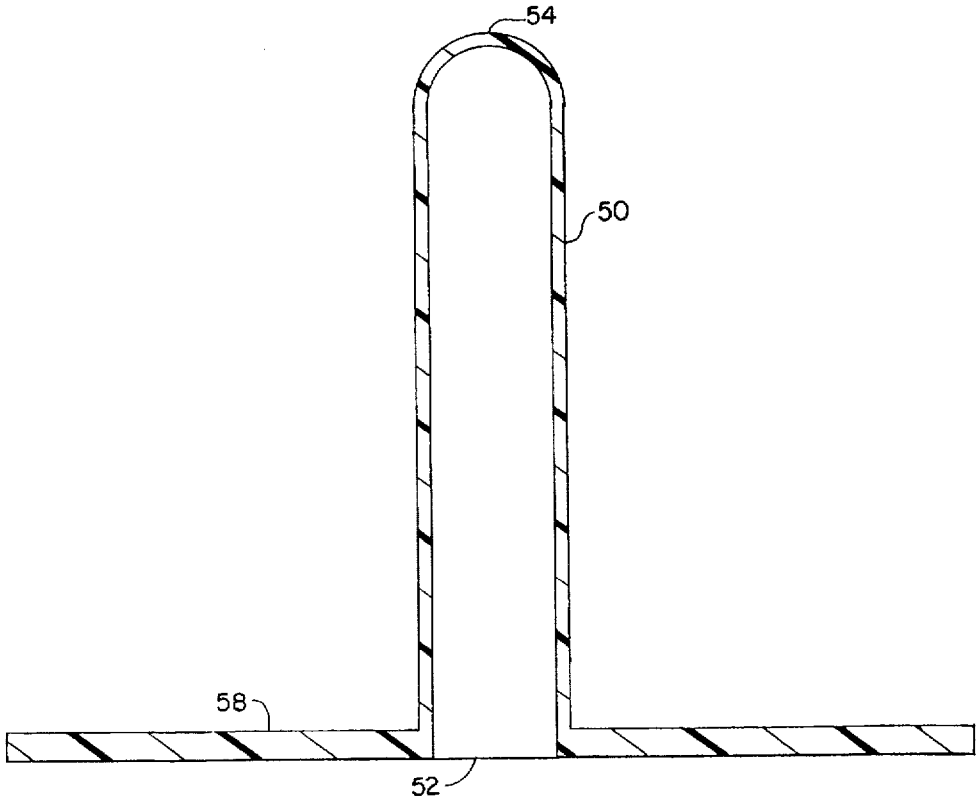
FIG. 3 is an enlarged sectional view of a portion of the liner of FIG. 2.
Figure 4:
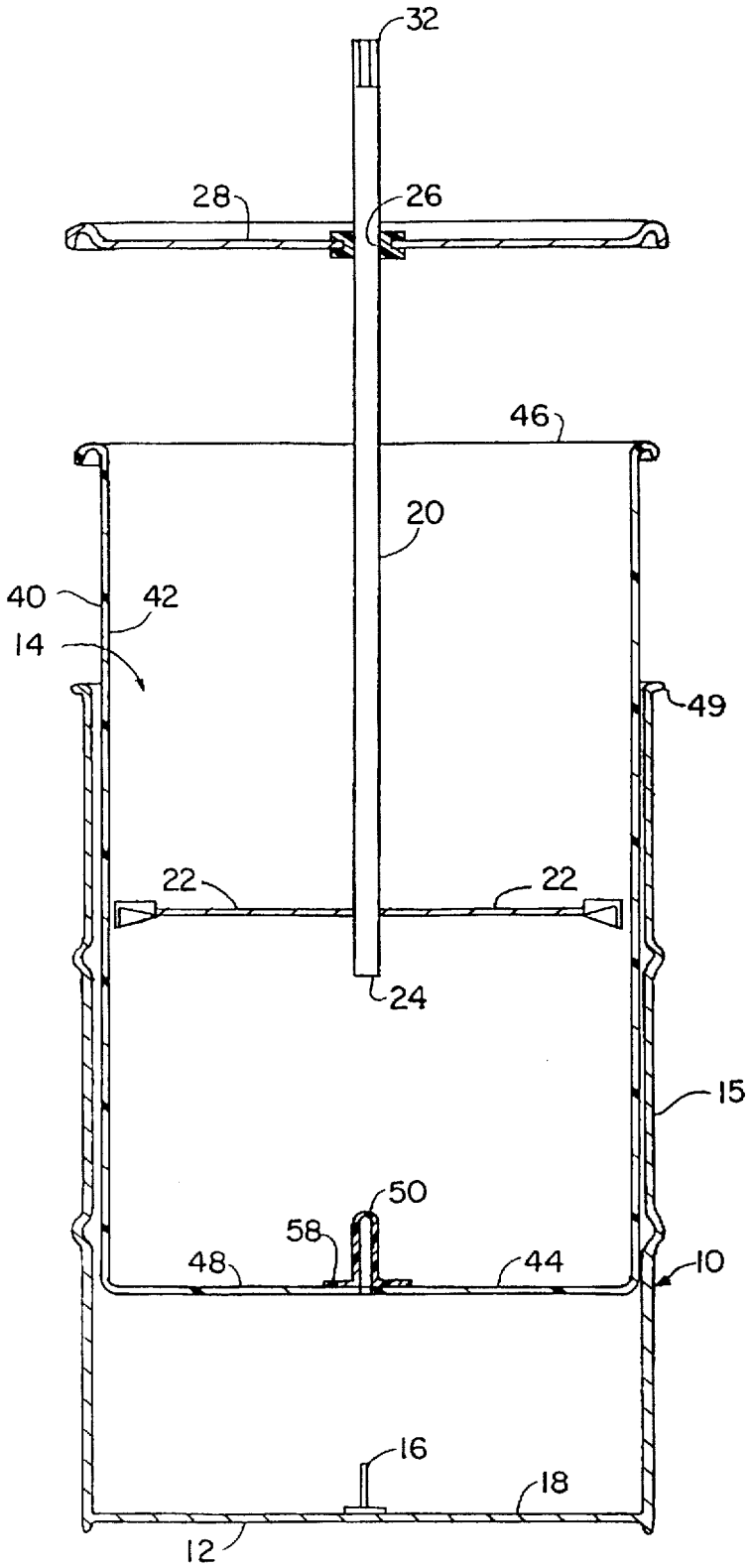
FIG. 4 is an exploded sectional view of one form of mixing assembly illustrative of an alternative embodiment of the invention.

A fitment 50 is fixed to the interior surface 48 of the bottom end 44 of the sleeve 42 and is open at a bottom end 52 (FIG. 3) thereof, and closed at a top end 54 thereof. The fitment 50 is of an elongated configuration generally complementary to the configuration of the post 16. The bottom end 44 of the sleeve 42 defines a hole 56 (FIG. 2) in alignment with the fitment open bottom end 52. The fitment 50 may be provided with a flange portion 58 by which the fitment 50 is affixed to the interior surface 48 of the sleeve bottom end 44, as by adhesive, ultra-sonic welding, heat sealing, or other bonding process.

Fitment 50 also is made of a plastic material or an elastomer, e.g. polypropylene, polyvinylechloride, or Teflon®. The essential requirement for fitment 50 is that it be relatively stiff so that it will resist twisting in response to rotation of shaft 20, yet will allow for tilting movement of post 16 to accommodate for non-alignment of shaft 20 with the longitudinal axis of container 10. Preferably, but not necessarily, fitment 50 is made of a material having a low friction so as to offer minimum resistance to rotation of shaft 20. Fitment 50 may, but need not, be made of an elastomeric material. Polyethylene or Teflon® are preferred materials for fitment 50.

Figure 5:
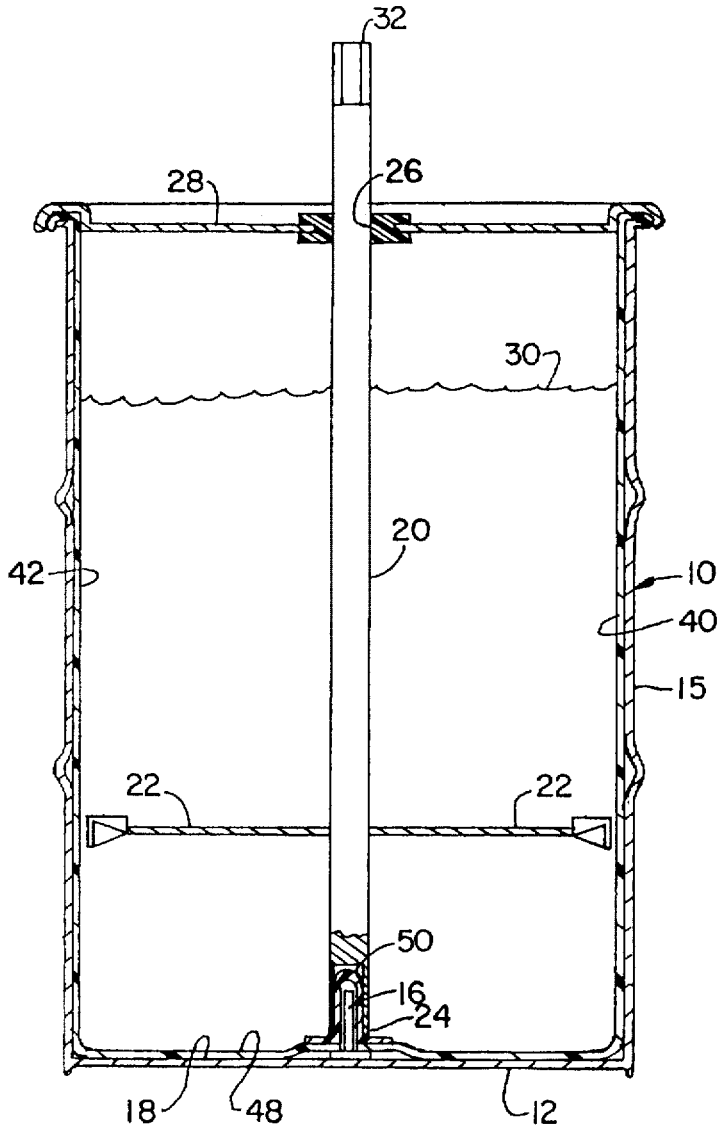
FIG. 5 is a sectional view of the assembly of FIG. 4 in fully assembled condition.

In operation, the liner 40 is inserted into the container 10, with the fitment 50 fitting over and receiving post 16 through the hole 56 and open bottom end 52 of the fitment 50. The fluid 30 (e.g., paint components) is then poured into the open end of liner 40. This tends to cause liner 40 to be pressed against the side and bottom end walls 12 of the container 10. The mixing shaft 20 is inserted into the container 10 over the fitment 50 and post 16. Being at least somewhat elastomeric, the fitment 50 is readily movable with the post 16 to facilitate mating with the bottom end 24 of mixing shaft 20. The cover member 28 is engaged with the upper end 46 of the sleeve 42 which preferably is formed as a cuff (as shown). The cover 28 is pressed down over the cuff-like open end 46 of sleeve 42 and the complementary rim 49 of container 10 to lock the cover 28 to the upper end 12 of the container 10, to close the assembly (FIG. 5). The mixing shaft 20 is then rotated by a rotative apparatus (not shown) engaged with the shaft top end 32.

Upon completion of the mixing operation, cover 28 and mixing shaft 20 are removed form the container 10, and the mixed paint (or other fluid) is removed from the container. Upon emptying of the container, the liner 40 is stripped from the container, the interior of which has been protected by the removed liner from contact with the fluid 30.

The liner may be made with a relatively small wall thickness, e.g., 0.004". Accordingly, since it also is flexible, the liner 40 may be folded into a relatively small volume of space, for disposal purposes, while the container may be re-used. The cost of liner 40 constitutes a fraction of the cost of the container 10 and the space required for disposal of the liner 40 is very much less than the space required for disposal of the container 10.

Thus, there is provided a disposable liner for use with known mixing containers, which liner is adapted to serve as a barrier between the containers and any fluids being mixed in the containers, whereby the interior of the container remains "clean" and enables repeated use of the container. There is further provided an assembly and method for mixing fluid components in a container, wherein the fluid components are separated by a disposable liner from contact with the interior of the container, whereby the container may be re-used for a multiplicity of operations, using a different liner for each mixing operation.

It is to be understood that the present invention is by no means limited to the particular construction and method steps herein disclosed an/or shown in the drawings, but also comprises any modifications or equivalents within the scope of the claims.

What is claimed is:

1. A liner for use with a mixing container having a post extending inwardly of the container and adapted to receive thereon a shaft having mixing members mounted thereon, said liner comprising:

a tubular sleeve that is closed at a first end thereof by an end wall, and is open at a second end thereof, said end wall of said sleeve defining a hole;

a tubular fitment fixed to the interior of said end wall, said fitment being closed at a first end thereof and open at a second end thereof, said open end being aligned with said hole in said end wall of said sleeve;

said sleeve being made of a deformable material.

2. The liner in accordance with claim 1 wherein said sleeve is made of an elastomeric material.

3. The liner in accordance with claim 1 wherein said fitment is made of an elastomeric material.

4. A liner for use with a paint mixing container having a bottom wall and a post upstanding from a center portion of said bottom wall, the post being adapted to receive thereon a shaft having (1) a recess in a bottom end thereof for accepting the post, and (2) mixing members extending outwardly from said shaft, the liner comprising:

a flexible fluid-impervious sleeve closed at a bottom end thereof and open at a top end thereof, said sleeve being of a configuration generally complementary to the interior configuration of the container;

a fitment fixed to the interior bottom end of said sleeve, said fitment having a tubular portion that is open at the bottom thereof and is closed at the top thereof, said fitment being of a configuration generally complementary to the configuration of the post; and said bottom end of said sleeve defining a hole in alignment with said fitment tubular portion;

whereby said liner is insertable into the container so that said liner conforms substantially to the interior configuration of the container and said fitment fits over the post and is adapted to receive and support the shaft.

5. An assembly for mixing fluid components, the assembly comprising:

a mixing container having a closed first end and an open second end;

a post fixed to an interior wall of said container and extending inwardly of said container;

a mixing shaft mountable over said post and having mixing members fixed thereon; and a liner disposed within said container, said liner comprising:

a sleeve closed at a first end thereof and open at a second end thereof, said sleeve having a configuration generally complementary to the interior configuration of said container;

a tubular fitment fixed to the closed first end of said sleeve, said fitment comprising a first open end and a second closed end, said tubular fitment being disposed over and enclosing said post; and;

said first end of said sleeve defining a hole in alignment with said first open end of said fitment;

said sleeve constituting a barrier between said container and said fluid components.

6. A method for mixing fluid components, the method comprising the steps of:

providing a mixing container having a closed bottom end and an open top end, and having a post fixed to and upstanding from the interior of the closed bottom end;

providing a cover member for the container, said cover member having a hole centrally thereof;

providing a mixing assembly including a rotatable shaft and mixing members fixed to the shaft;

providing a liner comprising a sleeve having a closed bottom end and an open top end, said sleeve having a configuration generally complementary to the interior configuration of the container, said liner including a fitment fixed to said bottom end of said sleeve, said fitment having a tubular portion that has an open bottom end and a closed top end, said fitment tubular portion being generally complementary to the configuration of the post, said bottom end of said sleeve also having a hole in alignment with said tubular portion of said fitment;

inserting said liner in the container so that said liner lies against the inner surfaces of the container, and said post is received by said tubular portion of said fitment;

admitting the fluid components to said liner;

positioning the mixing assembly shaft on said tubular portion of said fitment;

closing the open top end of the container with said cover member, with said shaft extending through the hole in said cover member, and rotating the shaft so that said mixing members will move through and mix said fluid components.

* * * * *